US008347454B2

(12) United States Patent
Ashbee et al.

(10) Patent No.: US 8,347,454 B2
(45) Date of Patent: Jan. 8, 2013

(54) SWIVEL ELECTRICAL CONNECTOR FOR A SUCTION HEAD OF A SURFACE TREATING APPLIANCE

(75) Inventors: Giles Ashbee, Malmesbury (GB); Robert Thomas Burnham, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 1081 days.

(21) Appl. No.: 12/276,088

(22) Filed: Nov. 21, 2008

(65) Prior Publication Data

US 2009/0133211 A1 May 28, 2009

(30) Foreign Application Priority Data

Nov. 23, 2007 (GB) ..... 0723013.9

(51) Int. Cl.
*A47L 9/00* (2006.01)
*A47L 9/02* (2006.01)

(52) U.S. Cl. ..... 15/351; 15/352; 439/191

(58) Field of Classification Search ..... 15/314, 15/321, 322, 351, 377, 414, 415.1, 419; 285/7, 285/907; 439/11, 131, 164, 172, 173, 191, 439/194, 195, 246–248, 287, 288, 347
See application file for complete search history.

(56) References Cited

U.S. PATENT DOCUMENTS

| | | | | |
|---|---|---|---|---|
| 2,538,296 | A * | 1/1951 | Crocker | 439/172 |
| 2,686,330 | A * | 8/1954 | Wales | 15/327.4 |
| 3,387,319 | A * | 6/1968 | Ferraris et al. | 15/327.7 |
| 3,434,092 | A | 3/1969 | Brown et al. | |
| 3,614,705 | A | 10/1971 | Descarries et al. | |
| 4,018,493 | A * | 4/1977 | Lyman et al. | 439/195 |
| 4,146,283 | A * | 3/1979 | Lienenluke et al. | 439/195 |
| 4,204,297 | A | 5/1980 | Yasunaga et al. | |
| 4,550,958 | A | 11/1985 | Smith | |
| 4,700,429 | A * | 10/1987 | Martin et al. | 15/377 |
| 4,719,314 | A * | 1/1988 | Nothnagel et al. | 174/481 |
| 4,928,346 | A * | 5/1990 | Elson et al. | 15/338 |
| 6,799,351 | B2 * | 10/2004 | Porath | 15/377 |
| 7,121,850 | B2 * | 10/2006 | Yeh | 439/131 |
| 7,226,302 | B2 * | 6/2007 | Walter et al. | 439/191 |
| 7,356,876 | B2 * | 4/2008 | Dant et al. | 15/414 |

(Continued)

FOREIGN PATENT DOCUMENTS

DE 3726778 A1 3/1989

(Continued)

OTHER PUBLICATIONS

GB Search Report dated Mar. 13, 2008, directed to GB Patent Application No. 0723013.9; 2 pages.

(Continued)

*Primary Examiner* — Joseph J Hail
*Assistant Examiner* — Tyrone V Hall, Jr.
(74) *Attorney, Agent, or Firm* — Morrison & Foerster LLP

(57) ABSTRACT

A surface treating appliance includes a main body and a head rotatably connected to the main body about an axis, the main body and the head being provided with first and second electrical connectors, respectively. The first and second electrical connectors can be connected to provide an electrical connection between the main body and the head. One of the first and second electrical connectors is slideable within a channel. By providing an electrical connector within a channel, complicated and potentially unreliable arrangements such as slip-rings can be avoided while still providing an electrical connection between the head and the main body.

8 Claims, 5 Drawing Sheets

U.S. PATENT DOCUMENTS

| | | | | |
|---|---|---|---|---|
| 8,099,830 | B2 * | 1/2012 | Linhart et al. | 15/410 |
| 2004/0194251 | A1 * | 10/2004 | Overvaag et al. | 15/377 |
| 2005/0060838 | A1 | 3/2005 | Walter et al. | |
| 2005/0095889 | A1 * | 5/2005 | Saitou et al. | 439/191 |
| 2005/0235454 | A1 * | 10/2005 | Courtney | 15/351 |
| 2006/0080803 | A1 * | 4/2006 | Stein | 15/377 |
| 2006/0174440 | A1 * | 8/2006 | Genoa et al. | 15/410 |
| 2009/0031526 | A1 * | 2/2009 | Linhart et al. | 15/410 |
| 2009/0056068 | A1 * | 3/2009 | Iseringhausen et al. | 15/412 |

FOREIGN PATENT DOCUMENTS

| | | | |
|---|---|---|---|
| EP | 0590690 | | 4/1994 |
| EP | 1838195 | A1 | 10/2007 |
| FR | 1434865 | | 4/1966 |
| JP | 54-36066 | | 3/1979 |
| JP | 2-75060 | | 6/1990 |
| JP | 2-185218 | | 7/1990 |
| JP | 2003-498 | | 1/2003 |
| JP | 2005-348940 | | 12/2005 |
| JP | 2006-198010 | | 8/2006 |
| JP | 2007-252695 | A | 10/2007 |
| WO | WO-2006/077382 | | 7/2006 |

OTHER PUBLICATIONS

International Search Report and Written Opnion mailed on Mar. 25, 2009 directed at counterpart application No. PCT/GB2008/003731; 13 pages.

* cited by examiner

SWIVEL ELECTRICAL CONNECTOR FOR A SUCTION HEAD OF A SURFACE TREATING APPLIANCE

REFERENCE TO RELATED APPLICATION

This application claims the priority of United Kingdom Application No. 0723013.9, filed Nov. 23, 2007, the contents of which are incorporated herein by reference.

FIELD OF THE INVENTION

The present invention relates to a surface treating appliance. Particularly, but not exclusively, the present invention relates to a vacuum cleaner.

BACKGROUND OF THE INVENTION

Vacuum cleaners are typically of the upright or cylinder type. Upright vacuum cleaners generally comprise a cleaner head and a main body. The cleaner head is pivotably attached to the main body which is supported on a pair of wheels and has a handle to allow the vacuum cleaner to be manipulated by a user. The cleaner head has a housing and a suction opening is formed in the lower part of the housing facing the floor surface. A brush bar is commonly located within the suction opening in order to agitate a floor surface to improve cleaning performance. The brush bar may be driven by an air turbine which uses the airflow drawn into the vacuum cleaner via the suction opening to rotate the brush bar. Alternatively, the brush bar may be driven by an electrical motor, either by a belt attached to a main vacuum motor, or by a dedicated brush bar motor.

When a dedicated brush bar motor is used, electrical connections to the brush bar motor must be provided. However, difficulties can arise when a cleaner head is required to swivel or pivot with respect to the main body because a positive electrical connection must be maintained across the swivel or pivotable connection.

Further difficulties can arise when the electrical connection is required to be disconnectable; for example, in the case of a cleaner head which is removable from the main body of the vacuum cleaner for storage or transportation purposes. An example of a known electrical connection between a removable cleaner head and the remainder of a vacuum cleaner is shown in U.S. Pat. No. 4,204,297. The cleaner head has a dedicated brush bar motor and is attached to the remainder of the vacuum cleaner by a rotatable mechanical coupling. The power connector for the brush bar motor is in the form of a cable which can be disconnected separately from the mechanical coupling. Such an arrangement requires a number of steps in order to disconnect the cleaner head, which is inconvenient for a user.

An improved arrangement is shown in U.S. Pat. No. 4,146,283. This document discloses a powered cleaner head which is removably attachable to a main body of a vacuum cleaner. A connector is provided to attach the head to the main body. The connector has an electrical connector which connects to a corresponding electrical connector on the main body when the head is attached to the main body. A rotatable coupling is formed between the connector and the head. The rotatable coupling is spaced from the electrical connectors. Although the above arrangement is more convenient for a user to assemble than the arrangement disclosed in U.S. Pat. No. 4,204,297, additional space is required to provide electrical connections separate from a rotatable coupling.

SUMMARY OF THE INVENTION

It is an object of the present invention to provide a surface treating appliance having a removable head which can be rotatably and electrically connected to a main body of the surface treating appliance easily by a user and which is more compact than existing arrangements.

According to the invention, there is provided a surface treating appliance comprising a main body and a head rotatably connected to the main body about an axis, the main body and the head being provided with first and second electrical connectors respectively, the first and second electrical connectors being connectable to provide an electrical connection between the main body and the head, wherein one of the first and second electrical connectors is slideable within a channel.

By providing a slideable electrical connector, complicated and potentially unreliable arrangements such as slip-rings can be avoided while still providing an electrical connection between the head and the main body. Further, by providing a channel, either the first or the second electrical connector is able to slide reliably within the channel when the head is rotated with respect to the main body.

Preferably, the channel is at least partly curved. More preferably, the channel is at least partly arcuate. More preferably, along the length of the channel, at least a part of the channel is spaced at a substantially constant distance from the axis.

By providing such an arrangement, the channel can be spaced from an axis of rotation about which the head and main body rotate with respect to one another. This allows the electrical connectors to be more conveniently located away from rotatable connections.

BRIEF DESCRIPTION OF THE DRAWINGS

An embodiment of the invention will now be described with reference to the accompanying drawings, in which.

DETAILED DESCRIPTION OF THE INVENTION

Figure 1:
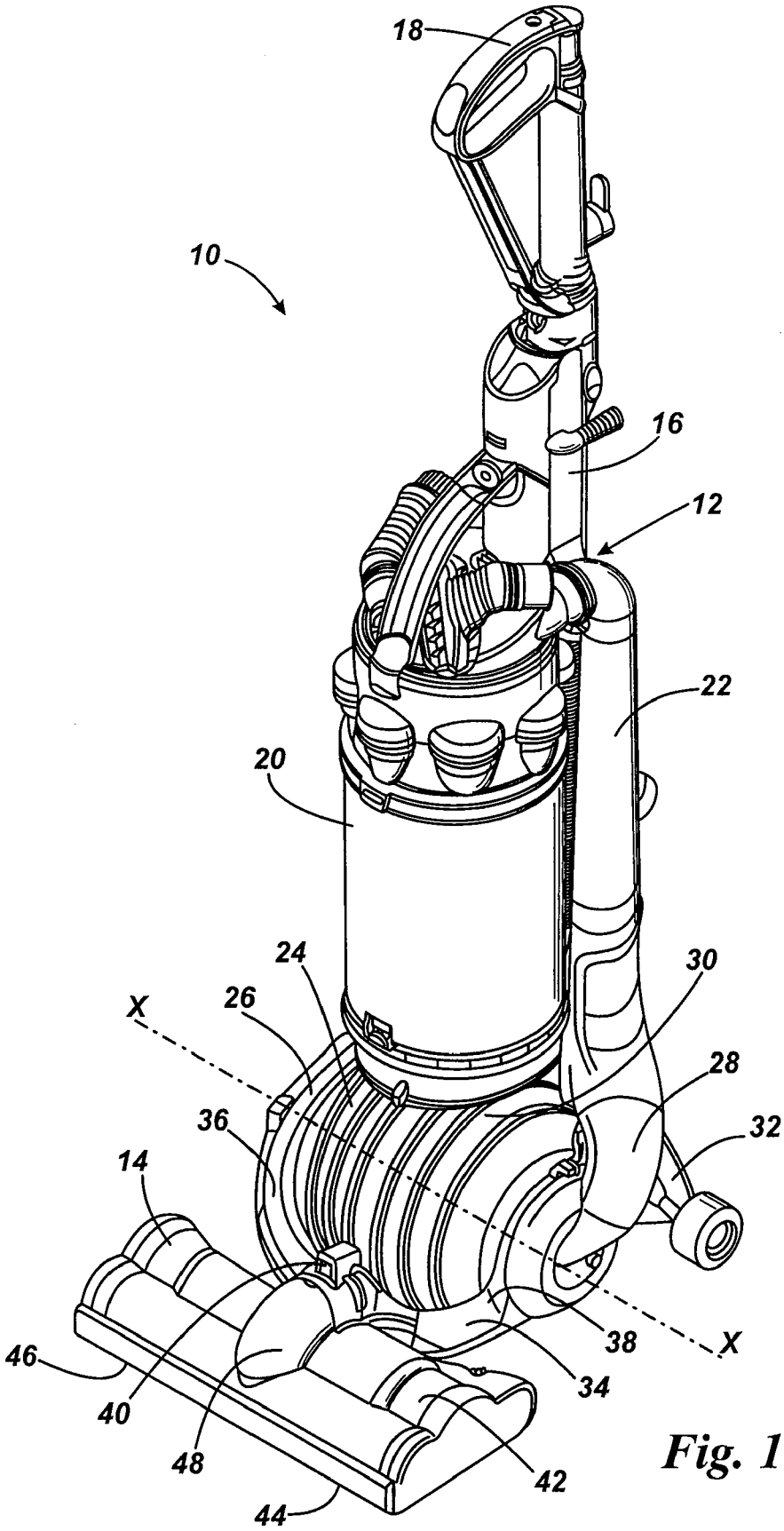
FIG. 1 shows an upright vacuum cleaner according to the invention.

An upright vacuum cleaner 10 according to the invention is illustrated in FIG. 1. The vacuum cleaner 10 has a main body 12 and a cleaner head 14. The main body 12 includes a spine 16 which extends upwards and merges into a handle 18. The handle 18 can be manipulated by a user to manoeuvre the vacuum cleaner 10 across a floor surface.

Separating apparatus 20 is releasably attached to the spine 16. The interior of the separating apparatus 20 is in communication with the main body 12 by way of ducting 22 located on the spine 16. The ducting 22 carries an airflow leaving the separating apparatus 20. In the embodiment shown, the separating apparatus 20 comprises a cyclonic separator but this could be replaced by a filter, a bag or a combination of different known separation devices. The nature of the separating apparatus 20 is not material to the present invention.

A rotatable support member 24 is located at the base of the main body 12 and supports the main body 12 on the floor surface. The support member 24 is rotatably connected to two support arms 26, 28 forming part of the main body 12. The support member 24 has an arcuate outer surface 30 when viewed in a lateral direction. The shape of the outer surface 30 allows the vacuum cleaner 10 to be maneuvered more easily across the floor surface than traditional vacuum cleaners having a pair of wheels.

A motor and fan unit (not shown) for drawing an airflow into the vacuum cleaner 10 is mounted inside the support member 24. The motor and fan unit is mounted so that the outer surface 30 of the support member 24 rotates around the motor and fan unit. The inlet to the motor and fan unit is formed in the support arm 28 which is in communication with the ducting 22. The support arm 28 and the ducting 22 define an airflow path from the separating apparatus 20 to the motor and fan unit.

In order to support the vacuum cleaner 10 when in an upright, stored position (as shown in FIG. 1), the main body 12 is provided with a stand 32. The stand 32 comprises a frame and a pair of wheels, and is shown in an extended position in FIG. 1. The stand 32 is retractable so that the vacuum cleaner 10 can be maneuvered in use. An example of a suitable stand is shown and described in EP 1 838 195.

The main body 12 further includes a yoke 34. The yoke 34 comprises two arms 36, 38 which are pivotably connected to the support arms 26, 28 on either side of the support member 24. The arms 36, 38, support arms 26, 28 and support member 24 are all connected about a common axis X-X. A duct is formed in the left-hand arm 36 of the yoke 34 and provides an airflow path between the cleaner head 14 and the separating apparatus 20.

Figure 5:
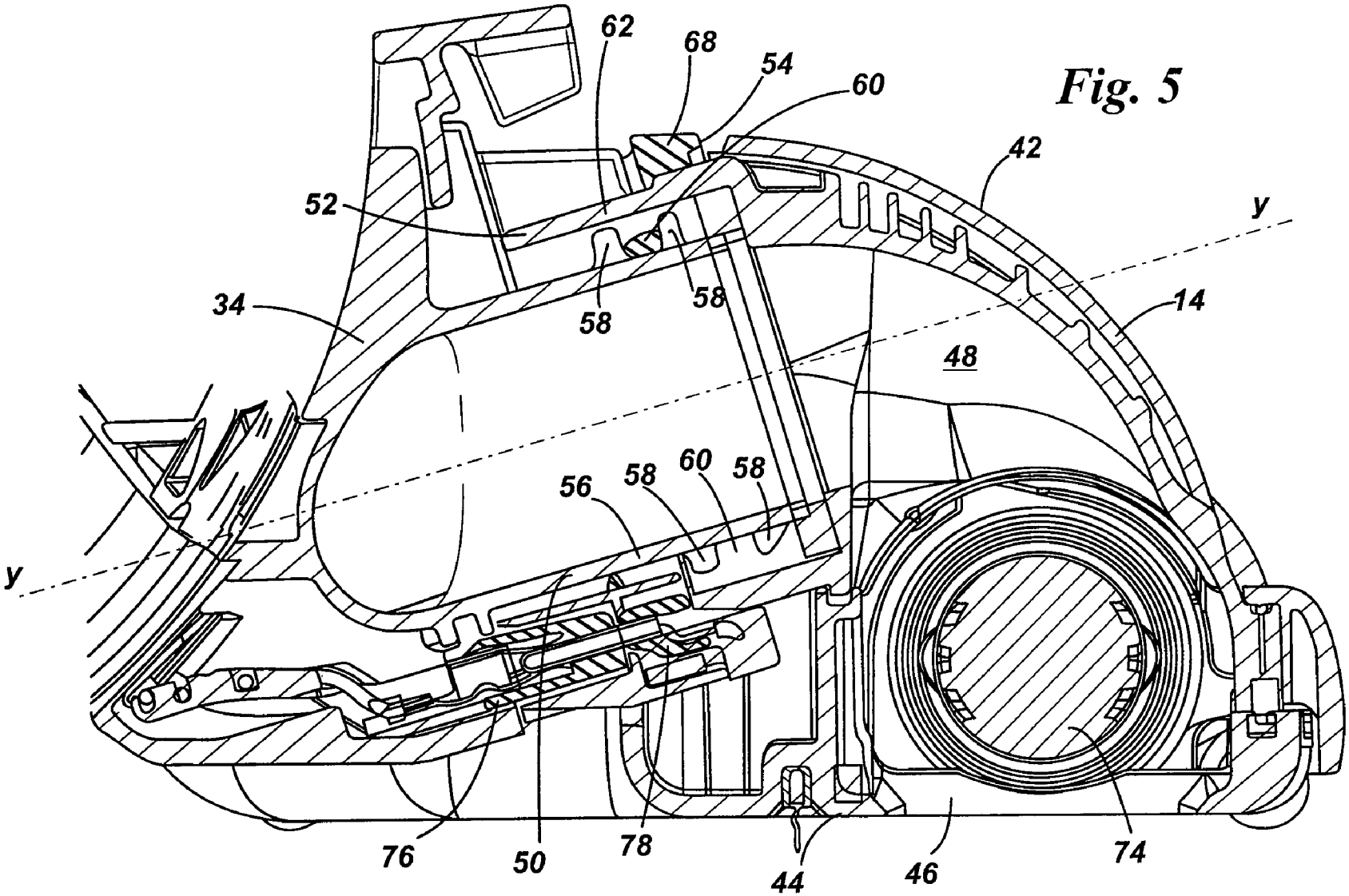
FIG. 5 is a side section through the cleaner head of FIG. 3.

The cleaner head 14 is rotatably connected to the yoke 34 by a connector 40. The cleaner head 14 has an upper surface 42 and a lower surface 44. The lower surface 44, which can be seen in FIG. 5, is arranged to face towards the floor surface and has a suction opening 46 formed therein. The suction opening 46 extends across substantially the entire width of the cleaner head 14. A suction conduit 48 is formed within the cleaner head 14 and is delimited by the upper and lower surfaces 42, 44. The suction conduit 48 forms a communication path between the suction opening 46 and the duct in the arm 36 of the yoke 34.

Figure 2:
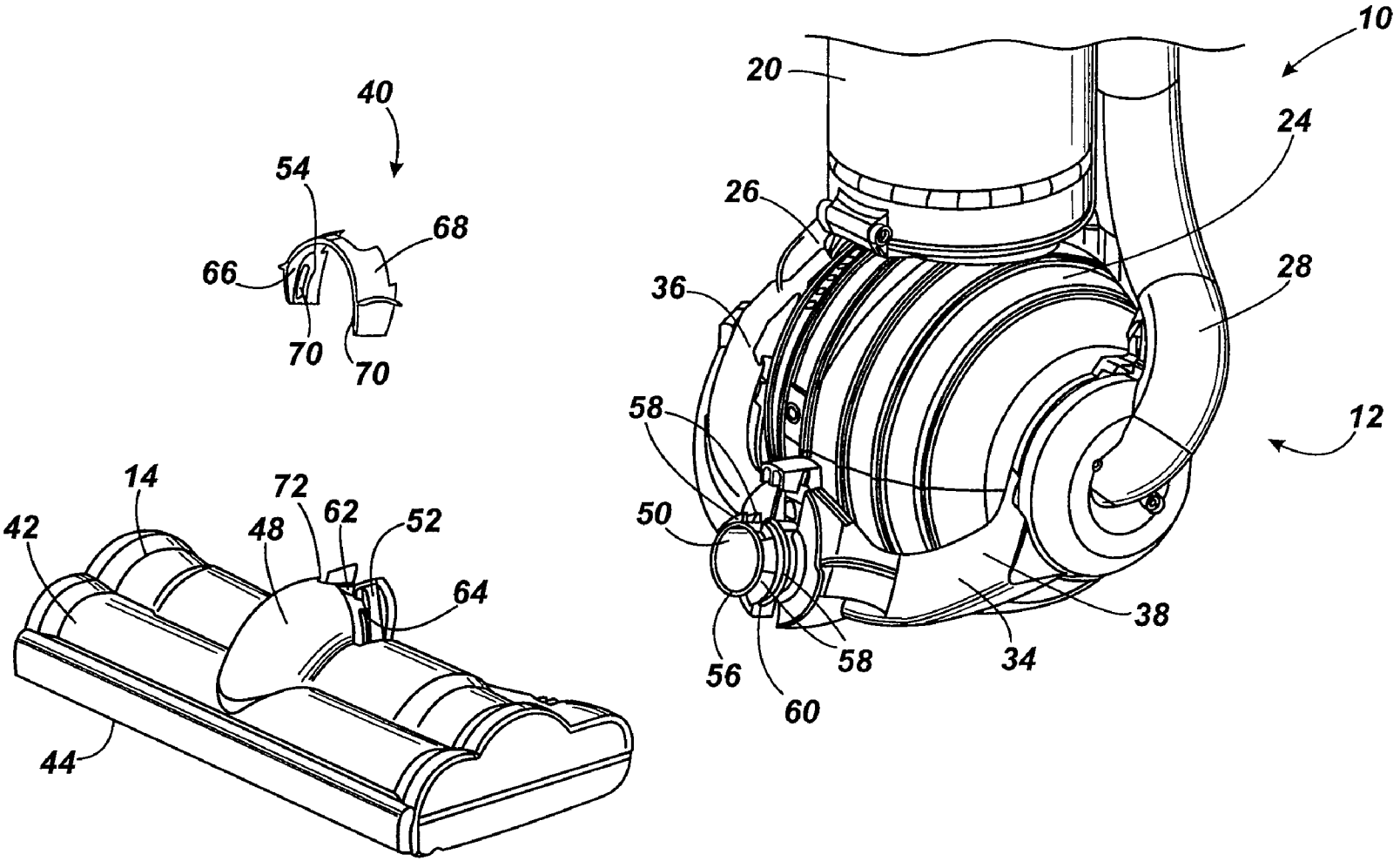
FIG. 2 is an exploded view of parts of the vacuum cleaner of FIG. 1.
Figure 3:
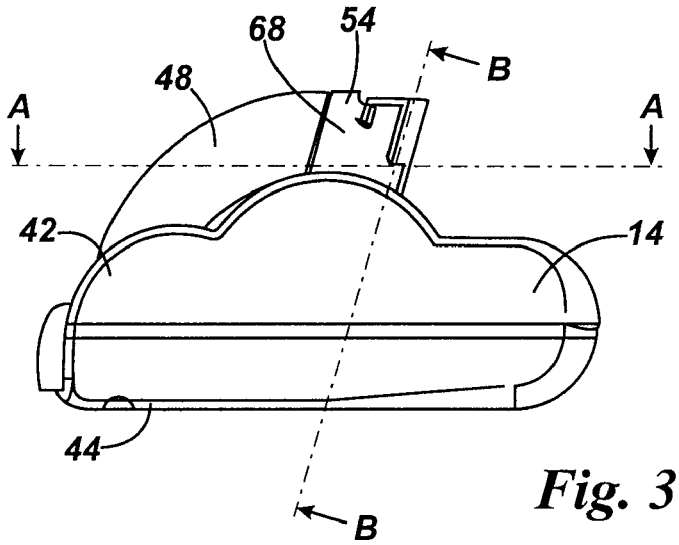
FIG. 3 is a side view of a cleaner head forming part of the vacuum cleaner of FIG. 1.

The cleaner head 14 and the connector 40 are shown in more detail in FIGS. 2 to 7. As shown in FIG. 2, the cleaner head 14 is removable from the main body 12. The connector 40 comprises a first part 50 located on the main body 12, a second part 52 located on the cleaner head 14 and a removable connecting member 54. The removal of the connecting member 54 from the remainder of the connector 40 enables the cleaner head 14 and the main body 12 to be separated from one another as described below.

The first part 50 is located on the main body 12 and comprises a cylindrical portion 56 which is hollow and forms an inlet to the duct located in the left-hand arm 36 of the yoke 34. Four walls 58 are located on the cylindrical portion 56 and extend around a part of the outer circumference thereof. The four walls 58 are arranged in two groups of two diametrically-opposed parallel walls 58, each group defining a groove 60 therebetween. The grooves 60 extend around a part of the outer circumference of the cylindrical portion 56. This is best shown in FIG. 2.

The second part 52 is located on the cleaner head 14 and comprises a cylindrical portion 62 located at one end of the suction conduit 48. The cylindrical portion 62 is dimensioned to receive the cylindrical portion 56 of the first part 50. Two elongate openings 64 are formed in the sides of the cylindrical portion 62. This can be seen most clearly in FIGS. 2 and 4.

The connecting member 54 is U-shaped and has inner and outer surfaces 66, 68. The inner surface 66 has two flanges 70 projecting therefrom. The flanges 70 project inwardly, perpendicular to the inner surface 66. The outer surface 68 is curved and is shaped to conform to the external surface of the vacuum cleaner 10. In other words, the outer surface 68 of the connecting member 54 forms a part of the external surface of the vacuum cleaner 10 when the connecting member 54 is located on the cleaner head 14. This can be seen in FIG. 3, which shows the connecting member 54 in place on the cleaner head 14. The connecting member 54 is resilient and is able to flex such that the separation between the flanges 70 can be increased or decreased. This allows the connecting member 54 to be snap fitted to the cleaner head 14.

Figure 4:
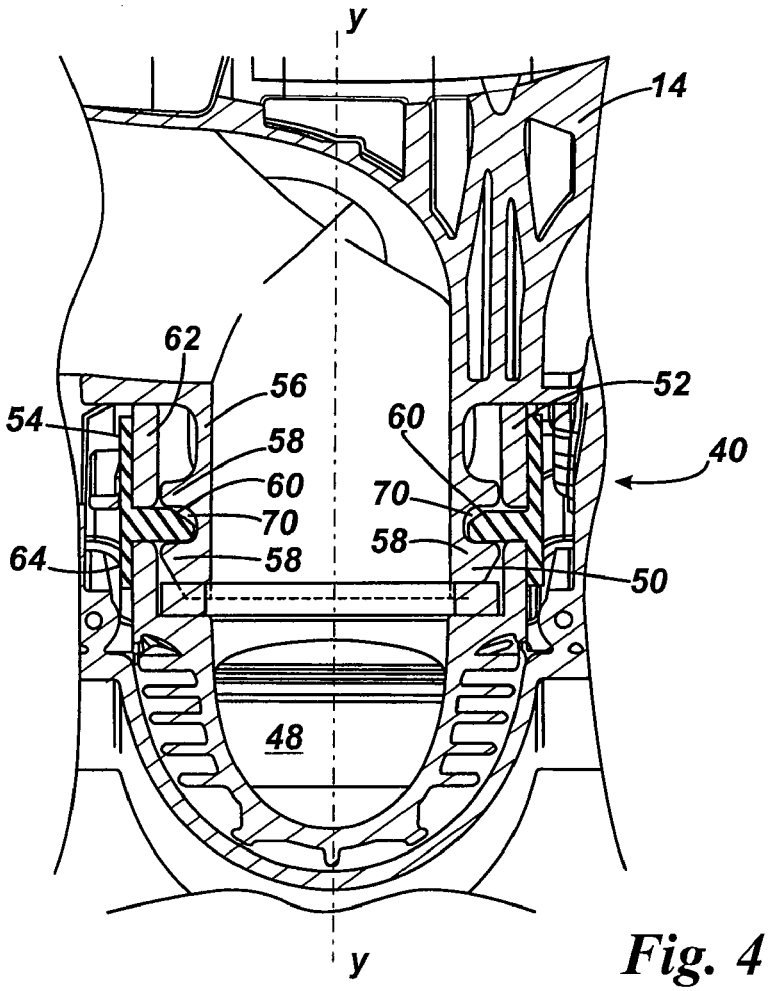
FIG. 4 is a section through the cleaner head of FIG. 3 taken along the line A-A of FIG. 3.

FIGS. 4 and 5 show cross sections through parts of the main body 12 and the cleaner head 14 showing the connector 40 in more detail. The first part 50 is received in the second part 52 such that the cylindrical portion 56 is located within the cylindrical portion 62. When the first and second parts 50, 52 are correctly located with respect to one another, each elongate opening 64 is aligned with a respective groove 60.

The connecting member 54 connects and secures the first and second parts 50, 52 to one another. Each flange 70 located on the connecting member 54 extends through a respective elongate opening 64 and into a respective groove 60. This is shown in FIG. 4. Due to the resilience of the connecting member 54, the flanges 70 are biased into the grooves 60 in a snap-fit arrangement. In this configuration, the first and second parts 50, 52 are able to rotate freely about an axis Y-Y (FIGS. 4 and 5), but cannot be disconnected due to the engagement between the flanges 70 and the grooves 60. In other words, the first and second parts 50, 52 are prevented from moving relative to one another along the axis Y-Y when the connecting member 54 connects the first and second portions 50, 52.

The provision of two grooves 60 which each cooperate with a flange 70 means that space is available between the grooves 60 around the circumference of the cylindrical portions 56, 62 for additional components of the vacuum cleaner 10, as will be described later.

The upper surface 42 has a notch 72 located adjacent the connecting member 54. This is shown most clearly in FIGS. 2 and 5. The notch 72 is provided so that the user can remove the connecting member 54 from the cleaner head 14 by inserting a suitable implement, such as a coin or screwdriver into the notch 72 and levering the connecting member 54 away from the cleaner head 14. Due to the resilience of the connecting member 54, the connecting member 54 is arranged to flex and snap out of position when levered away from the cleaner head 14.

As shown in FIG. 5, a rotatable brush bar 74 is located in the suction conduit 48. The brush bar 74 is driven by a brush bar motor (not shown) which has an electrical connection to the main body 12 of the vacuum cleaner 10. The electrical connection comprises a first electrical connector 76 located on the yoke 34, and a second electrical connector 78 located on the cleaner head 14. The first and second electrical connectors 76, 78 are shown in FIG. 5 and are located below the first and second parts 50, 52 of the connector 40 respectively. The first electrical connector 76 is fixed with respect to the first part 50 and is located between the grooves 60 around the circumference of the first part 50. The first and second electrical connectors 76, 78 connect to one another in a standard male/female arrangement which is well known.

Figure 6:
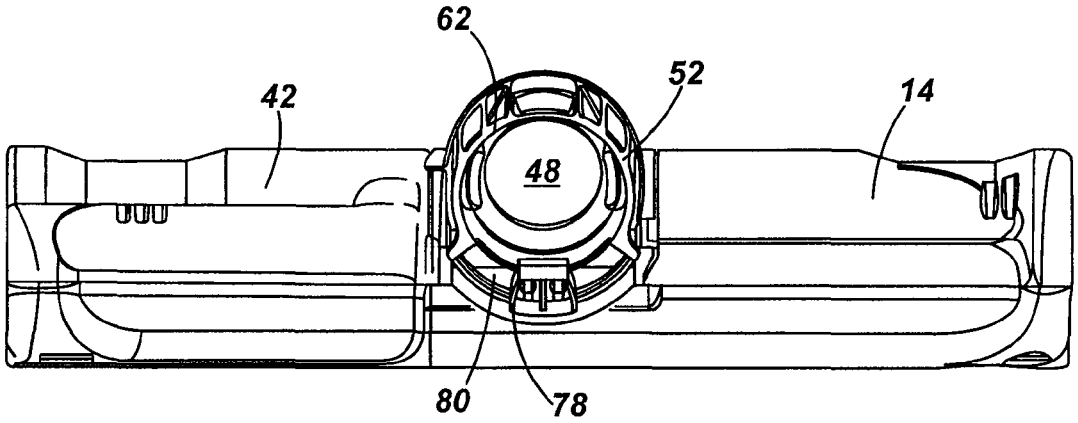
FIG. 6 is a rear view of the cleaner head of FIG. 3.
Figure 7:
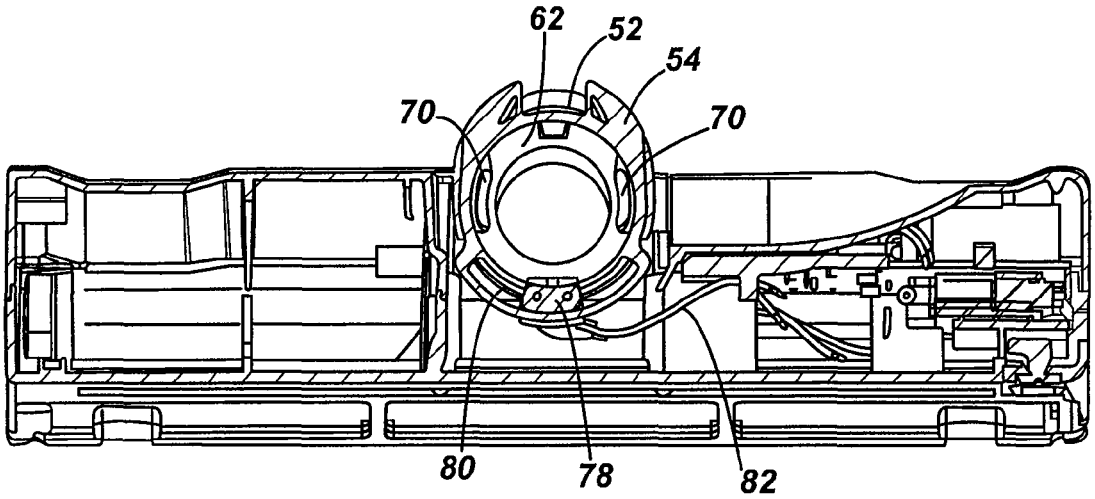
FIG. 7 is a section through the cleaner head of FIG. 3 taken along the line B-B of FIG. 3.

FIGS. 6 and 7 show rear views of the cleaner head 14. The second electrical connector 78 is located in a curved channel 80 and is free to move therein. The curved channel 80 is located on the circumference of the cylindrical portion 62 between the two elongate openings 64. The channel 80 is arcuate and, along the length of the channel 80, is spaced at a substantially constant distance from the axis Y-Y. This means that, when the cleaner head 14 is rotated with respect to the main body 12 about the axis Y-Y, the second electrical connector 78 is able to slide smoothly within the channel 80. The second electrical connector 78 is able to move within the channel 80 with respect to the remainder of the cleaner head 14. The second electrical connector 78 is connected electrically to the brush bar motor by an electrical wire 82. The electrical wire 82 is able to move with the second electrical connector 78 and is sufficiently long so that it does not impede the movement of the second electrical connector 78.

When the cleaner head 14 is attached to the main body 12 (as shown in FIG. 5), the second electrical connector 78 is connected to, and remains fixed with respect to, the first electrical connector 76. Therefore, when the cleaner head 14 is rotated with respect to the main body 12 about the axis Y-Y, the second electrical connector 78 moves along the curved channel 80 relative to the cleaner head 14 but remains fixed relative to the main body 12.

The arrangement described above is particularly suited to a small upright vacuum cleaner, commonly known as a stick-vacuum. Stick-vacuums are generally much smaller in size that conventional upright vacuum cleaners. The above arrangement allows the connector to be small, yet to be robust and easy to disconnect. Consequently, the provision of a smaller connector allows the vacuum cleaner to be reduced in size.

In use, the user starts with the vacuum cleaner 10 in the stored configuration shown in FIG. 1. In the stored configuration, the cleaner head 14 is attached to the main body 12, the spine 16 is upright and the stand 32 is in the extended position. To use the vacuum cleaner 10, the user switches the vacuum cleaner 10 on so that the motor and fan unit draws a dirty airflow into the vacuum cleaner 10 via the suction opening 46 and the brush bar motor rotates the brush bar 74.

The brush bar 74 agitates the floor surface and dislodges dirt and dust from the floor surface. This dirt and dust is carried in the dirty airflow from the suction opening 46, through the suction conduit 48, along the duct 36 and into the separating apparatus 20. Dirt and dust is separated from the airflow by the separating apparatus 20 and retained therein. The cleaned air then passes from the separating apparatus 20 along the ducting 22, through a pre-motor filter (not shown), across the motor and fan unit for cooling and through a post-motor filter (not shown) before being exhausted from the vacuum cleaner 10.

In order to move the vacuum cleaner 10 from the stored position to an in-use position, the user must retract the stand 32. The user can then manipulate the handle 18 to manoeuvre the vacuum cleaner 10 across the floor surface to be cleaned. In order to turn the vacuum cleaner 10 in a new direction (for example, to clean around furniture or walls), the user twists the handle 18, which causes the main body 12 to rotate. When the main body 12 is rotated, the first and second parts 50, 52 rotate with respect to one another about the axis Y-Y so that the cleaner head 14 remains on the floor surface when the user twists the handle 18.

When the first and second parts 50, 52 are rotated with respect to one another, the cylindrical portion 56 rotates inside the cylindrical portion 62. Each of the flanges 70 formed on the connecting member 54 slides within a respective groove 60, allowing rotational movement while preventing the first and second parts 50, 52 from becoming separated. In other words, the connecting member 54 connects and secures the cleaner head 14 to the main body 12, preventing the cleaner head 14 from becoming detached, but allowing free rotation therebetween. The flanges 70 run smoothly inside the grooves 60 so that there is little frictional resistance to rotation between the first and second parts 50, 52. This makes the vacuum cleaner 10 easy to turn in a new direction.

The brush bar motor located in the cleaner head 14 is electrically connected to the main body 12 by the connection between the first and second electrical connectors 76, 78 and the electrical wire 82. Further, when the cleaner head 14 is rotated with respect to the main body 12, the second electrical connector 78 will move within the channel 80. Since the electrical wire 82 is able to move with the second electrical connector 78, the electrical connection between the main body 12 and the brush bar motor is maintained even when the main body 12 is rotated with respect to the cleaner head 14. This arrangement is small in size, simple to implement and requires fewer components than known arrangements which use, for example, slip rings to transfer electric current across a rotatable connection.

When the user has finished the cleaning operation, the vacuum cleaner 10 is switched off. In order to return the vacuum cleaner 10 to a storage configuration as shown in FIG. 1, the user pushes the handle 18 and spine 16 back into the vertical position. This action extends the stand 32. The vacuum cleaner 10 is now back in the configuration shown in FIG. 1.

It may be desired to remove the cleaner head 14 for cleaning, storage or transportation. In order to do this, the user inserts a suitable tool (such as a coin or screwdriver) into the notch 72 and levers the connecting member 54 upwards. Since the connecting member 54 and notch 72 are located on the external surface of the vacuum cleaner 10, they are immediately visible and easy to access. As the connecting member 54 is moved upwards, the outer surface 68 of the connecting member 54 is no longer flush with the upper surface 42 of the cleaner head 14 and the yoke 34. Therefore, it can easily be grabbed by the user and removed. Further, due to the resilience of the connecting member 54, the connecting member 54 flexes and snaps out of position when levered away from the cleaner head 14.

When the connecting member 54 is removed, the flanges 70 are removed from the grooves 60. Therefore, the first and second parts 50, 52 can be separated, and the cleaner head 14 can be removed from the main body 12.

When the cleaner head 14 is removed in this manner, the first and second electrical connectors 76, 78 are pulled apart. This breaks the electrical connection between the cleaner head 14 and the main body 12, preventing electrical shocks and allowing the cleaner head 14 to be cleaned, stored or packed separately from the remainder of the vacuum cleaner 10.

The invention is not limited to the detailed description given above. Variations will be apparent to the person skilled in the art. For example, the head need not be removable from the main body. Other forms and arrangements may be used; for example, the brush bar motor may be removable from the head and disconnectable from the remainder of the surface treating appliance by disconnecting the second electrical connector from the first electrical connector.

Other forms of connector may be used. There need not be first and second parts which are connectable. Further, there need not be a connecting member. Additionally, the connector need not be adapted and arranged to carry a fluid flow. A separate fluid conduit, such as a hose, may be provided separate from the connector.

The second electrical connector need not be slideable relative to the head. Instead, the first electrical connector may be slideable within a channel located on the main body and the second electrical connector may remain fixed with respect to the head.

Additionally, the channel need not be curved. Other arrangement could be used; for example, a straight channel, a sloping channel or a notched channel.

The term "surface treating appliance" is intended to have a broad meaning, and includes a wide range of machines having a head for travelling over a surface to clean or treat the surface in some manner. It includes, inter alia, machines which apply suction to the surface so as to draw material from it, such as vacuum cleaners (dry, wet and wet/dry), as well as machines which apply material to the surface, such as polishing/waxing machines, pressure washing machines, ground marking machines and shampooing machines. It also includes lawn mowers and other cutting machines.

The invention claimed is:

1. An upright vacuum cleaner surface treating appliance comprising a main body including a separating apparatus releasably attached thereto, and a cleaner head rotatably connected to the main body about an axis by a connector including a cylindrical first part located on the main body and a cylindrical second part located on the cleaner head, the connector carrying fluid flow between the cleaner head and the main body, wherein the main body has a first electrical connector and the cleaner head has a second electrical connector, the first and second electrical connectors being connectable and disconnectable, and wherein the first and second electrical connectors are connectable to provide an electrical connection between the main body and the cleaner head, wherein the first electrical connector is fixed with respect to the first cylindrical part, and wherein the second electrical connector is located in a curved channel defined on the circumference of the cylindrical second part and is slidable along the channel with respect to the cleaner head such that, when the cleaner head is rotated with respect to the main body about the axis, the second electrical connector moves along the curved channel relative to the cleaner head but remains fixed relative to the main body.

2. The upright vacuum cleaner surface treating appliance of claim 1, wherein the channel is at least partly curved.

3. The upright vacuum cleaner surface treating appliance of claim 1, wherein the head is removably connected to the main body.

4. The upright vacuum cleaner surface treating appliance of claim 3, wherein the first and second electrical connectors are located adjacent the cylindrical first and second parts of the connector respectively.

5. The upright vacuum cleaner surface treating appliance of claim 3, wherein the channel is located adjacent the cylindrical second part of the connector.

6. The upright vacuum cleaner surface treating appliance of claim 3, wherein main body further comprises a rotatable support member for supporting the main body on a floor surface, the rotatable support member having an arcuate surface.

7. The upright vacuum cleaner surface treating appliance of claim 1, wherein the head further comprises a motor, the second electrical connector being connected to the motor.

8. The upright vacuum cleaner surface treating appliance of claim 7, wherein the head further comprises a suction opening and a brush bar located adjacent the suction opening, the brush bar being driven by the motor.

* * * * *